US008671822B2

(12) United States Patent
Depiak et al.

(10) Patent No.: US 8,671,822 B2
(45) Date of Patent: Mar. 18, 2014

(54) FLUID DRIVEN RECIPROCATING LINEAR MOTOR

(75) Inventors: Adam Depiak, Calgary (CA); Karol Depiak, Calgary (CA)

(73) Assignee: Depiak Industrial Technology Corporation, Calgary (CA)

( * ) Notice: Subject to any disclaimer, the term of this patent is extended or adjusted under 35 U.S.C. 154(b) by 719 days.

(21) Appl. No.: 12/850,279

(22) Filed: Aug. 4, 2010

(65) Prior Publication Data

US 2011/0030547 A1 Feb. 10, 2011

Related U.S. Application Data

(60) Provisional application No. 61/231,266, filed on Aug. 4, 2009, provisional application No. 61/361,843, filed on Jul. 6, 2010.

(51) Int. Cl.
*F01L 31/00* (2006.01)
*F01L 15/18* (2006.01)

(52) U.S. Cl.
USPC ..... 91/348; 91/329

(58) Field of Classification Search
USPC ..... 91/303, 329, 348
See application file for complete search history.

(56) References Cited

U.S. PATENT DOCUMENTS

| | | | | | |
|---|---|---|---|---|---|
| 109,167 | A | * | 11/1870 | Ambos | 91/329 |
| 2,948,224 | A | * | 8/1960 | Bailey et al. | 91/303 |
| 4,293,287 | A | * | 10/1981 | Carrens | 91/329 |
| 4,768,589 | A | | 9/1988 | Roeder | |
| 5,676,033 | A | * | 10/1997 | Szabo | 91/348 |
| 2005/0098028 | A1 | * | 5/2005 | Johnson | 91/303 |

FOREIGN PATENT DOCUMENTS

| | | |
|---|---|---|
| CA | 1166075 | 4/1984 |
| GB | 2437742 A | 11/2007 |

* cited by examiner

*Primary Examiner* — Michael Leslie
(74) *Attorney, Agent, or Firm* — Bennett Jones LLP

(57) ABSTRACT

A reciprocating linear motor powered by one directional fluid flow is provided, having small external diameter, optimized for length, with few moving parts and effective seals, low mass and thus low inertia in direction changes. The motor provides reciprocating linear powered motion for use by attached equipment such as a pump, chisel, hammer, valve, or other machine requiring such power.

11 Claims, 10 Drawing Sheets

FLUID DRIVEN RECIPROCATING LINEAR MOTOR

CROSS REFERENCE TO RELATED APPLICATIONS

The present application claims priority to U.S. provisional application Ser. No. 61/231,266 filed Aug. 4, 2009 and to U.S. 61/361,843 filed Jul. 6, 2010.

FIELD OF THE INVENTION

The invention has to do with provision of powered linear motion to equipment by a motor. It is known in the art to provide reciprocating linear motion powered remotely to tools such as a pump in a well. Typically, such pumps may have spring-returns, a variety of one-way valves, solenoids if powered by electricity, and generally speaking are provided at one end of an assembly comprising the motor, its reciprocation-controlling componentry, and a pump, assembled in a sequence.

Typical motors of this type have a driven shaft which operates under compression, requiring large amounts of materials to defeat buckling forces.

As well, the larger drive shaft results in greater mass, the direction of motion of which involves defeating greater inertia, and larger collision forces. Some motors have complex latch-releases or are powered in one direction opposing a spring which powers them in another direction. Still others have stall positions within the travel of their components, resulting in the potential of accidental stalls from which the motors cannot recover without being physically retrieved and serviced or pushed somehow past the stall point of travel in the reciprocating movement's path. Others suffer from blow-by and have difficulties maintaining seals to isolate working parts from harsh environments and contaminants. Most have larger numbers of moving parts, with excessive susceptibility to wear. Some require the power source to switch, others require carefully controlled pressures and volumes of motive power fluids.

A need is recognized to provide short length, small diameter linear motors driven by pressurized fluid in one-directional unswitched flow, with few moving parts, provided with useful seals and isolating small tolerance piston/cylinder arrangements from the motor's working environment.

SUMMARY OF THE INVENTION

The present invention relates to valve assemblies that can convert one directional flow of fluid power medium into mechanical reciprocating action.

This invention provides in one embodiment a motor for providing powered reciprocating linear drive motion using a pressurized power fluid flow, the motor comprising: a housing having a first end and a second end; a first chamber provided in the housing proximate the first end of the housing, the first chamber having a first piston and operative to provide motive linear power during a power stroke of the first piston; a second compression chamber provided in the housing proximate the second end of the body, the second compression chamber having a second piston and operative to provide motive linear power during a power stroke of the second piston, the second piston connected to the first piston such that a power stroke of the first piston causes an exhaust stroke of the second piston and a power stroke of the second piston causes an exhaust stroke of the first piston; the first chamber in fluid communication with the power fluid flow during a power stroke of the first piston and in fluid communication with a first exhaust port during an exhaust stroke of the first piston; and a second chamber in fluid communication with the power fluid flow during a power stroke of the second piston and in fluid communication with a second exhaust port during an exhaust stroke of the second piston; the motor in one embodiment further comprising a reversing sleeve provided between the first piston and the second piston, the reversing sleeve having a first end partially defining the first chamber and a second end partially defining the second chamber, wherein the reversing sleeve is operative to expose the first chamber to the first exhaust port during an exhaust stroke of the first piston and to block the first exhaust port during a power stroke of the first piston, and wherein the reversing sleeve is operative to expose the second chamber to the second exhaust port during an exhaust stroke of the second piston and block the second exhaust port during a power stroke of the second piston; wherein the reversing sleeve has a first reversing sleeve exhaust port, in fluid communicating with the first chamber, that substantially aligns with the first exhaust port during an exhaust stroke of the first piston and a second reversing sleeve exhaust port, in fluid communication with the second chamber, that substantially aligns with the second exhaust port during an exhaust stroke of the second piston; the sleeve further comprising a first inlet port in fluid communication with the power fluid flow and a second inlet port in fluid communication with the power fluid flow, wherein the first chamber is in fluid communication with the first inlet port during a power stroke of the first piston and the second chamber is in fluid communication with the second inlet port during a power stroke of the second piston, and where the reversing sleeve blocks the first chamber from the first inlet port during an exhaust stroke of the first piston and the reversing sleeve blocks the second chamber from the second inlet port during an exhaust stroke of the second piston, the motor in an embodiment further comprising: a reversing spool provided within the reversing sleeve and having a first end and a second end, the reversing sleeve and the reversing spool partially defining the first chamber and the second chamber; wherein when the first piston in its motion is proximate an end of a power stroke, the second piston contacts the second end of the reversing spool, forcing the reversing spool towards the first piston, and moving the reversing sleeve towards the first piston causing the reversing sleeve to place the second chamber in fluid communication with the power fluid flow and venting the first chamber to exhaust, and wherein when the second piston in its motion is proximate an end of its power stroke, the first piston contacts the first end of the reversing spool, forcing the reversing spool towards the second piston and causing the reversing sleeve to place the first chamber in fluid communication with the power fluid flow and venting the second chamber to exhaust, where the reversing spool includes a position piston to hold the reversing spool in position and a balancing pressure piston to counteract pressure forces on the reversing spool, wherein the first piston, the first chamber, a connecting rod connected between the first piston and the second piston, the second piston and the second compression chamber are all aligned in a single line and the housing and the outer housing are cylindrical, wherein the first chamber and second chamber are in fluid isolation from each other, and where in one embodiment the motor is configured for seal-less operation; yet in another embodiment the motor further comprises a first sealing ring 34A encircling the first piston and separating the motor's environment from the first chamber and a second sealing ring 34B encircling the second piston and separating the motor's environment from the second chamber.

The invention further comprises a method of providing reciprocating linear motion powered by one directional fluid flow, the method comprising: providing a motor having a first piston defining a first chamber, a second piston defining a second chamber, the first piston and the second piston connected with a connecting rod so that the first piston and the second piston move in unison one pulling the other, the first chamber and the second chamber positioned between the first piston and the second piston; supplying power fluid under pressure to the first chamber to drive the first piston through a power stroke and the second piston through an exhaust stroke; when the first piston reaches an end of its power stroke, supplying power fluid to the second chamber to drive the second piston through a power stroke of its own; and when the second piston has reached the end of its power stroke, again supplying power fluid to the first chamber; in one embodiment the motor energizes equipment placed down a well casing to operate or condition the well; in another, the motor is inserted in a well casing with a tubing string supplying power fluid to the motor; in another where used power fluid is exhausted from the motor into a first annulus between the tubing string and well casing; in another embodiment, a second tubing string is provided inside the tubing string and power fluid is supplied to the motor through the second tubing string, and used power fluid is exhausted to a second annulus formed between the tubing string and the second tubing string.

A further embodiment of the invention further provides a motor with a hydraulic/pneumatic valve for converting one directional flow of power medium (fluid being a liquid or gas) into mechanical reciprocating motion, the motor comprising: a first piston, acting at the same time as an attaching platform to a mechanism to be powered by the motor, defining a first compression chamber and a second piston, acting at the same time as an attaching platform to the mechanism to be powered by the motor, defining a second compression chamber, the pistons connected together with a connecting rod so that the first piston and the second piston are forced to move in conjunction; their movement being coordinated by tension on the rod; around the connecting rod, a valve comprising a reversing spool provided within a reversing sleeve and having a first end and a second end, the reversing sleeve and the reversing spool partially defining the first compression chamber and the second compression chamber; the reversing sleeve having a first end partially defining the first compression chamber and a second end partially defining the second compression chamber, operating to open the first compression chamber to the power fluid and open the second compression chamber to an exhaust vent during the first piston power stroke, and to open the second compression chamber to the power fluid and open the first compression chamber to the exhaust vent during the second piston power stroke; when the first piston is proximate an end of its power stroke, the second piston contacts the second end of the reversing spool, forcing the reversing spool towards the first piston, and moving the reversing sleeve towards the first piston causing the reversing spool to place the second valve chamber in fluid communication with the at least one power fluid supply and venting the first chamber to exhaust and forcing the reversing sleeve towards the first piston; and when the second piston is proximate an end of its power stroke, the first piston contacts the first end of the reversing spool, forcing the reversing spool towards the second piston and causing the reversing spool to place the first compression chamber in fluid communication with the at least one power fluid supply and venting the second compression chamber to exhaust and forcing the reversing sleeve towards the second piston; where the valve's reversing spool also includes a position piston to hold the reversing spool in position and a balancing pressure piston to counteract pressure forces on the reversing spool, wherein the first piston, the first compression chamber, the connecting rod connected between the first piston and the second piston, the second compression chamber and the second piston are all aligned in a line.

In yet a further embodiment, the invention provides a method of inducing a reciprocating movement to a motor's connecting rod, the method comprising: providing a valve having a first piston defining a first compression chamber, a second piston defining a second compression chamber, the first and the second piston connected with a connecting rod so that the first piston and the second piston move in unison, the first chamber and the second chamber positioned between the first and the second piston; supplying power fluid to the first chamber to drive the first piston through a power stroke and the second piston through an exhaust stroke; when the first piston reaches an end of the power stroke, supplying power fluid to the second chamber to drive the second piston through a subsequent power stroke; and when the second piston has reached the end of the subsequent discharge stroke, supplying power fluid to the first chamber.

In another embodiment, a reciprocating linear motor powered by one directional fluid flow is provided, having small external diameter, optimized for shortened overall length, with few moving parts and effective seals, low mass and thus low inertia in direction changes. The motor provides reciprocating linear powered motion for use by attached equipment such as a pump, chisel, hammer, valve, remote actuator, or other machine requiring such power.

It is to be understood that other aspects of the present invention will become readily apparent to those skilled in the art from the following detailed description. As will be realized, the invention is capable for other and different embodiments and its several details are capable of modification in various other aspects, all without departing from the spirit and scope of the present invention. Accordingly, the drawings and detailed description are to be regarded as illustrative in nature and not as restrictive.

BRIEF DESCRIPTION OF THE DRAWINGS

Referring to the drawings, wherein like reference numerals indicate similar parts throughout, the several views are illustrated by way of example, and not by way of limitation.

DETAILED DESCRIPTION

Figure 1:
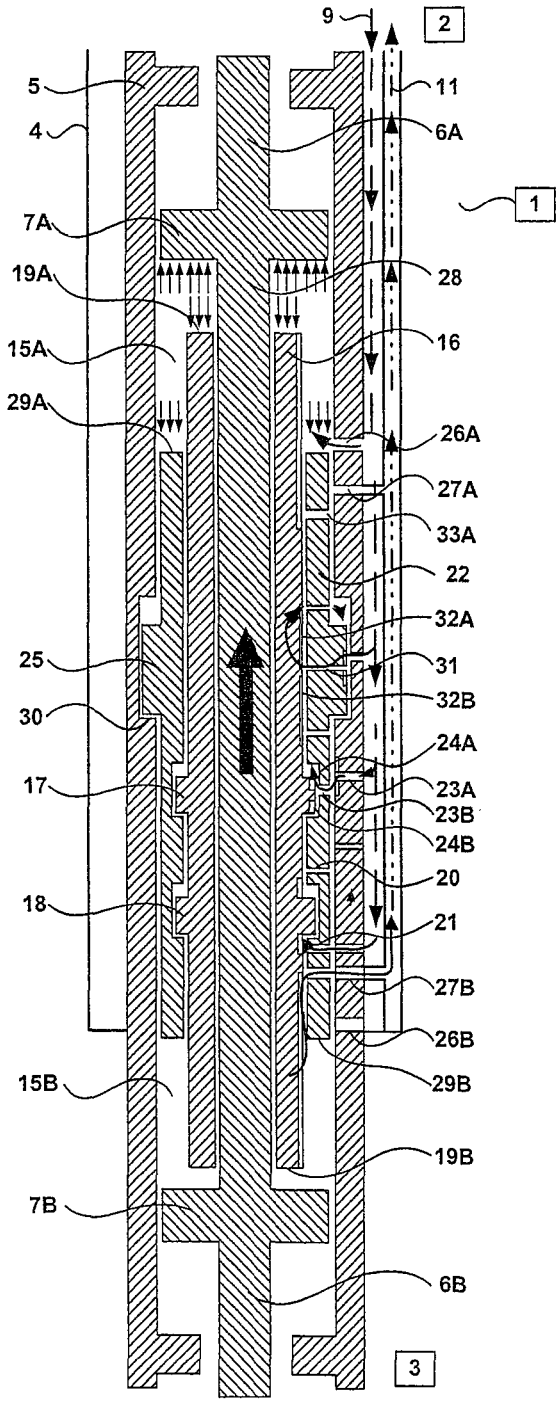
FIG. 1 is a schematic illustration of an embodiment of a valve assembly.

This invention herein provides a motor comprised of a valve assembly that can convert one directional flow of a power medium into powered reciprocating motion of power rods. The reciprocating movement of these rods can be in turn applied in a mechanism that requires such powered reciprocating motion, e.g. pumps, hammers, chisels, compactors, jacks, remotely controlled valves, actuators, remote hydraulic/pneumatic servo mechanisms and the like.

The invention contemplates in one embodiment a form of reciprocating control valve which at the limits of its stroke causes the reversal of fluid flow under pressure to a piston assembly. The invention is also concerned with the aspects of automatic and positive control and in accordance with or in response to the valve piston assembly travel, the retention of the valve in either its two operative or pressure fluid transmitting positions by providing an arrangement for valve blocking, in the nature of exposing auxiliary pistons to the system pressure by which to positively position the valve in one or the other functional position with no dead, stalled, or equilibrium position.

FIGS. 1-5 are schematic illustrations of a valve assembly in a first aspect. Pistons 7A and 7B with power rods 6A and 6B the body of which extends through the center of the motor as attaching the two pistons 7A and 7B in tension and not necessarily in compression, the reciprocating movement of the rods 6A and 6B can be attached to and utilized by a mechanism that requires such reciprocating motion, e.g. pumps, hammers, chisels, compactors, jacks, remotely controlled valves, actuators, remote hydraulic/pneumatic servo mechanisms and the like.

Valve assembly 1 can have a first end 2, a second end 3, an outer housing 4, and an inner housing 5 provided within the outer housing 4. The inner housing 5 can contain a first compression chamber 15A and a second compression chamber 15B, wherein the first compression chamber 15A may be positioned adjacent the first piston 7A, and the second compression chamber 15B maybe positioned adjacent the second piston 7B. The first piston 7A and the second piston 7B maybe connected together with a connecting rod 28 so that the first piston 7A and second piston 7B can be forced to move in conjunction by the connecting rod 28. The first piston 7A and the second piston 7B may be provided with extrusions i.e. power rods 6A and 6B, respectively. The reciprocating movement of the power rods 6A and 6B, depending on the application, can be used to power various mechanisms or tools.

In FIGS. 1-5, the outer housing 4 is shown with a power fluid supply conduit 9 that may run between the outer housing 4 and the inner housing 5 and supply power fluid to drive the assembly 1. A fluid discharge conduit 11 may be provided within the outer housing 4, but outside the inner housing 5, a power fluid may be exhausted directly to the motor's surroundings by bents 27A, 27B.

Power fluid can be directed in an alternating way into the first compression chamber 15A and the second compression chamber 15B to drive the connecting rod of assembly 1. To drive the first piston 7A through a power stroke, power fluid may be directed into the first compression chamber 15A and to drive the second piston 7B through a power stroke, power fluid may be directed into the second chamber 15B.

In a preferred embodiment, the connector between pistons operates moving in a linear manner concentrically through the motor's control valve system, comprised of a reversing spool 16 concentrically inside a reversing sleeve 22, within the motor's body which also comprises an inner housing 5 and an outer housing 4.

The annulus between inner 5 and outer 4 housings may provide fluid conduits for supply and, optionally exhaust of a power fluid flow under pressure during operation of the motor. The annulus between the inner housing 5 and the reversing sleeve 22 provides a positioning 17 and a balancing 18 piston and corresponding cylinder arrangements, with conduits 20, 21 through the sleeve 22 to provide power fluid to those pistons, the respective conduits 20, 21 being opened or closed, respectively, by positioning of the sleeve 22, to provide pressurized power fluid to one side or the other of piston 18 to exert a force toward one end or the other 2,3 of the assembly 1.

Several advantages of this arrangement become apparent: the direction control over fluid flow takes place between the two cylinders decreasing the length of the assembly 1 from end-to-end (2 to 3); there is no catchment, spring, mechanical détente or similar biasing means to prevent the motor from reaching a stall or equilibrium position, also reducing the parts count and complexity, as well as wear points and mass of parts in motion and thus reducing inertial changes required in each reciprocation's direction change; improving maintainability, serviceability and useful life-cycle. Further, the two main pistons 7A and 7B are joined by a connector which operates in tension during both power strokes, and need not be built to withstand compressive forces of the pistons' motion, thus reducing mass, inertia change, collision forces in operation and stress on material, improving motor efficiencies and life-span.

Note that the only physical contact required is between the pistons 7A or 7B and the reversing spool 16. The reversing sleeve 22 is moved not by the physical contact but by the hydraulic force produced by redirecting of the hydraulic pressure through the respective movement of the reversing spool 22. Therefore the entire process is relatively shock free since the hydraulic medium will cushion the impact. Shock forces of collision between powered pistons 7A or 7B with the sleeve and spool of the assembly 1 at the end of a power stroke may be absorbed by fluid reservoirs within the power fluid deployed in the balancing or position pistons' chambers eliminating dead-stop collisions and reducing shock stress changes to materials.

With only 3 moving parts (pistons 7A, 7B and connector; reversing sleeve 22; and reversing spool 16) assembly, disassembly, and maintenance of the motor is simplified.

A reversing spool 16 may have a position piston 17 and a balancing pressure piston 18. The balancing pressure piston 18 can equalize forces acting on the reversing spool during the operation of the assembly 1, exerting a force on the reversing spool 16 acting in an opposite direction to the force exerted by power fluid on either the first end 19A or the second end 19B of the reversing spool 16. A first balancing pressure piston passage 20 and a second balancing pressure piston passage 21 may be provided in the reversing sleeve 22. Based on the position of the reversing sleeve 22, either the first balancing pressure piston passage 20 or the second balancing pressure piston passage 21 may be placed in fluid communication with power fluid supply conduit 9 to supply power fluid to one of the sides of the balancing pressure piston 18. If the reversing sleeve 22 is positioned so that the first balancing pressure piston passage 20 is provided in fluid communication with the power fluid supply conduit 9, the power fluid passing through the first balancing pressure piston passage 20 to the balancing pressure piston 18 exerts a force on the balancing pressure piston 18 towards the second end 3 of the assembly 1. If the reversing sleeve 22 is positioned so that the second balancing pressure piston passage 21 is provided in fluid communication with the power fluid supply conduit 9, the power fluid passing through the second balancing pressure piston passage 21 to the pressure balancing piston 18 exerts a force on the balancing pressure piston 18 towards the first end 2 of the assembly 1.

Power fluid in either the first compression chamber 15A or the second compression chamber 15B can apply a force to first end 19A of the reversing spool 16 or the second end 19B of the reversing spool 16, respectively. The balancing pressure piston 18 can exert a force on the reversing spool 16 in an opposite direction from the force exerted by the power fluid in either the first compression chamber 15A or the second compression chamber 15B. By adjusting the surface area of the first end 19A and the second end 19B of the reversing spool 16 with the surface area of the balancing pressure piston 18, the forces placed on the reversing spool 16 can be substantially balanced, with the pressure balancing piston 18 substantially counteracting the forces placed on the reversing sleeve 16 by the power fluid in either the first compression chamber 15A or the second chamber 15B.

With the force exerted on either the first end 19A of the second end 19B of the reversing spool 16 substantially counteracted by the balancing pressure piston 18, the reversing spool 16 may be held in place by the position piston 17. Power fluid from the power fluid supply conduit 9 maybe routed to either side of position piston 17 to hold the reversing spool 16 in place. A first fluid supply passage 23A maybe provided in the inner housing 5 in fluid communication with the power fluid supply conduit 9. A second fluid supply passage 23B maybe provided in the reversing sleeve 22 that may align with the first fluid supply passage 23A. A first slot 24A and a second slot 24B maybe provided on the position piston 17 which can route power fluid from the fluid supply 9 and the fluid supply 23B to either side of the position piston 17, depending on the position of the reversing spool 16. By altering the surface area of the position piston 17, the amount of force required to shift the reversing spool 16 can be adjusted.

In this manner, the pressure balancing piston 18 can counteract the forces on the reversing spool 16 from the first compression chamber 15A and the second compression chamber 15B, wherein the position piston 17 can hold the reversing spool 16 in position and the motor by tailoring how much force is required to shift the reversing spool 16.

A reversing sleeve piston 25 may be provided to shift the reversing sleeve 22.

Referring to FIG. 1, the assembly 1 is shown during a power stroke of the first piston 7A and a discharge stroke of the second piston 7B. The reversing sleeve 22 maybe initially positioned towards the second end 3 of the assembly 1, exposing the power fluid inlet port 26A to the first compression chamber 15A, placing the first compression chamber 15A in fluid communication with the power fluid supply conduit 9, while blocking the exhaust port 27A. At the same time, the reversing sleeve 22 can expose the second exhaust port 27B to the second compression chamber 15B while blocking the power fluid inlet port 26B from the second compression chamber 15B. With power fluid entering the first compression chamber 15A adjacent the first piston 7A and fluid being vented from the second chamber 15B adjacent the second piston 7B, the first piston 7A may be driven through a power stroke while the second piston 7B may be pulled along by the connecting rod 28.

During the power stroke of the first piston 7A, the power fluid may exert a force on the first piston 7A as well as a first side 19A of the reversing spool 16 and a first side 29A of the reversing sleeve 22. The force exerted on the first side 19A of the reversing spool 16 by the power fluid in the first compression chamber 15A maybe substantially counteracted by the force exerted on the reversing spool 16 by the pressure balancing piston 18 with the position piston 17 exerting a force on the reversing spool 16 towards the second end 3 of the assembly 1 and pressing the reversing spool 16 against the reversing sleeve 22. The reversing sleeve 22 maybe pressed against a bumper 30 in the inner housing 5.

When the first piston 7A reaches the top of a power stroke, the reversing sleeve 22 and the reversing spool 16 may act in conjunction to reverse the direction of motion of the first piston 7A and the second piston 7B.

Figure 2:
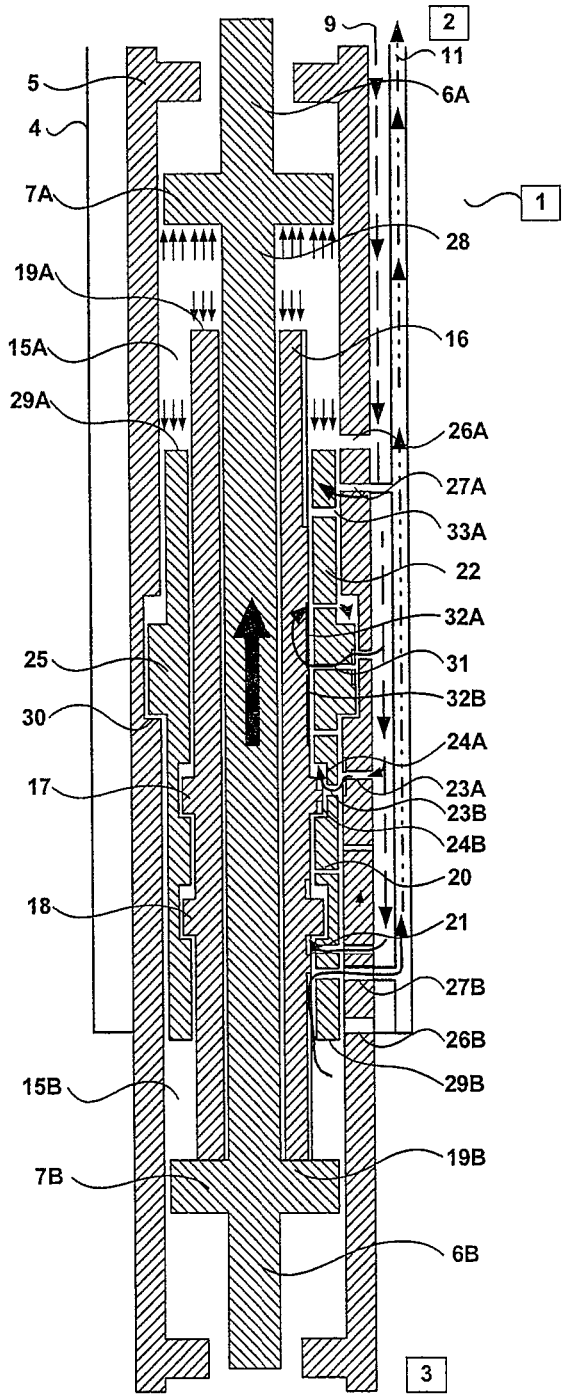
FIG. 2 is a schematic illustration of the valve assembly of FIG. 1, during a power stroke by a top piston.

Referring to FIG. 2, as the first piston 7A reaches an end of the power stroke, a bottom of the second piston 7B may come into contact with the second end 19B of the reversing spool 16. Because of the balancing of the forces on the reversing spool by the balancing pressure piston 18, the second piston 7B may only have to exert a force on the reversing spool 16 to overcome the force exerted on the reversing spool 16 towards the second piston 7B by the position piston 17. With the first piston 7A overcoming the force placed on the reversing spool 16 by the position piston 17, the reversing spool 16 maybe shifted by the second piston 7B towards the first end 2 of the assembly 1.

Figure 3:
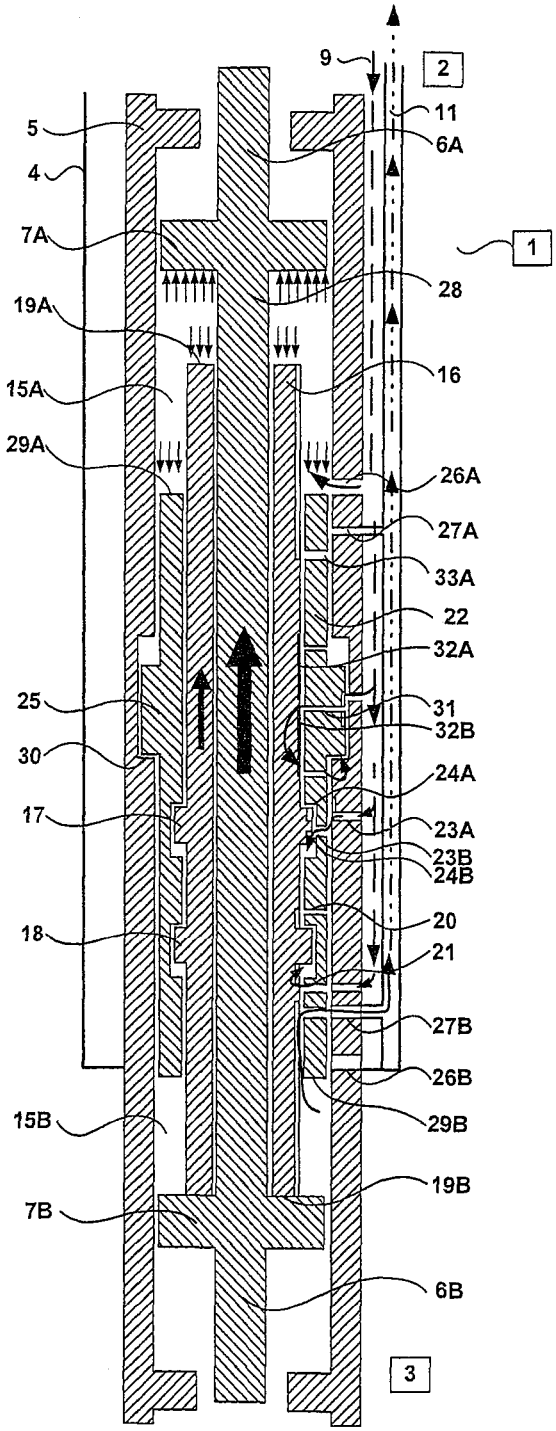
FIG. 3 is a schematic illustration of the valve assembly of FIG. 1, during a changing of direction of motion by the top piston.
Figure 4:
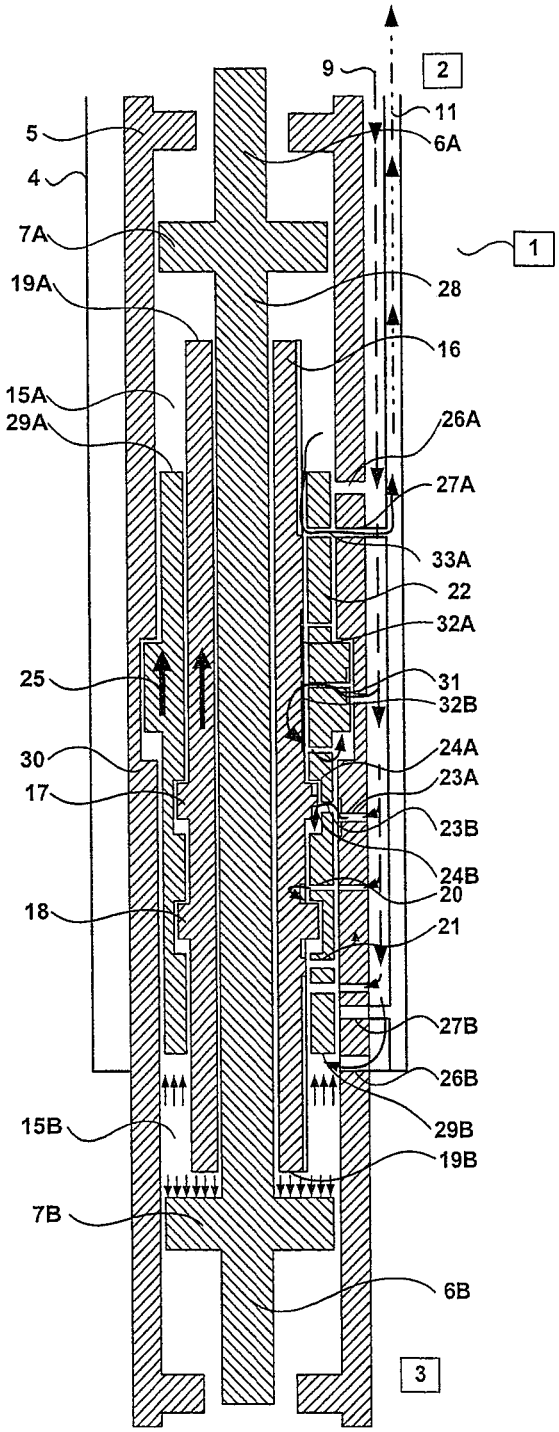
FIG. 4 is a schematic illustration of the valve assembly of FIG. 1, during a reversal of motion.

Referring to FIG. 3, with the reversing spool 16 shifted towards the first end 2 of the assembly 1, power fluid maybe directed to the other side of the position piston 17 which can cause the force exerted on the reversing spool 16 by the position piston 17 to act in the direction of the force exerted on the reversing spool 16 by the second piston 7B. The shifting of the reversing spool 16 may move the first slot 32A away from the reversing sleeve piston passage 31 and place the second slot 32B in fluid communication with the reversing sleeve piston passage 31 which can route power fluid from the power fluid supply conduit 9 to the other side of the reversing sleeve piston 25. The force exerted on the other side of the reversing sleeve piston 25 can drive the reversing sleeve 22 towards the first end 2 of the assembly 1, shifting the reversing sleeve 22, as shown in FIG. 4.

Figure 5:
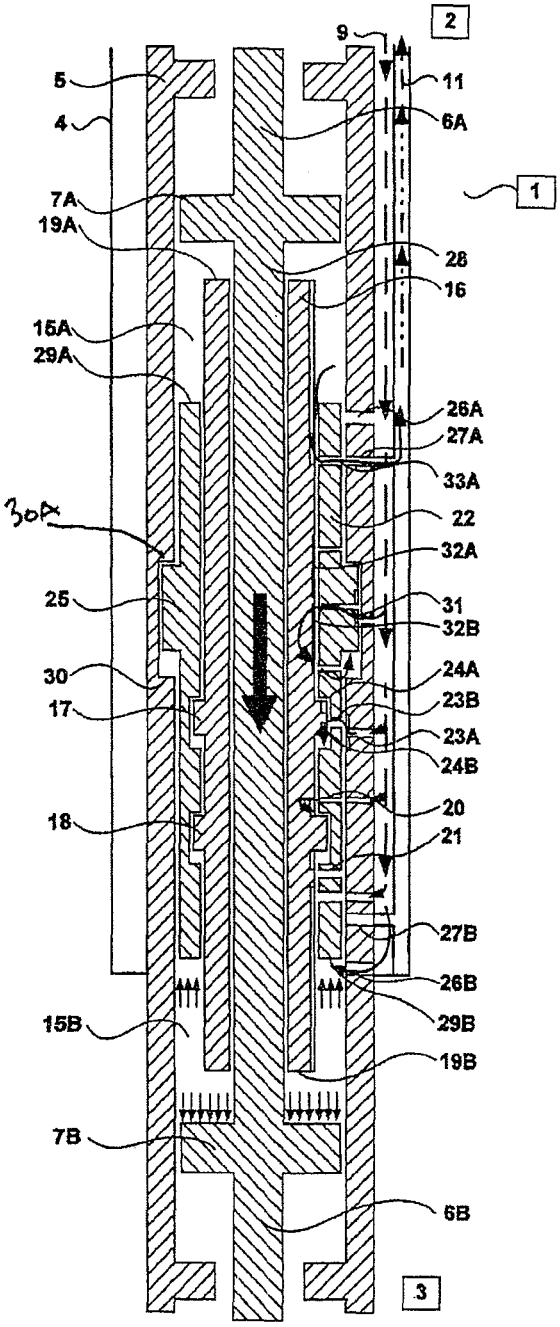
FIG. 5 is a schematic illustration of the valve assembly of FIG. 1, during a discharge stroke by the top piston.
Figure 6:
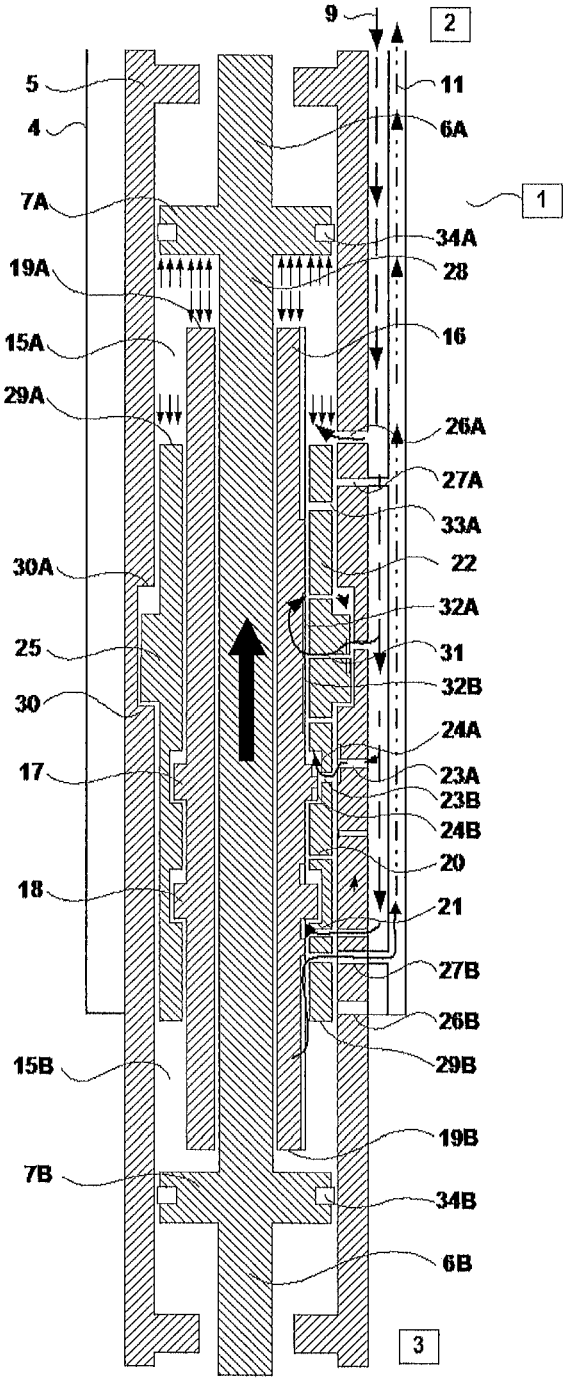
FIG. 6 is a schematic drawing of a valve assembly showing certain seals.
Figure 7:
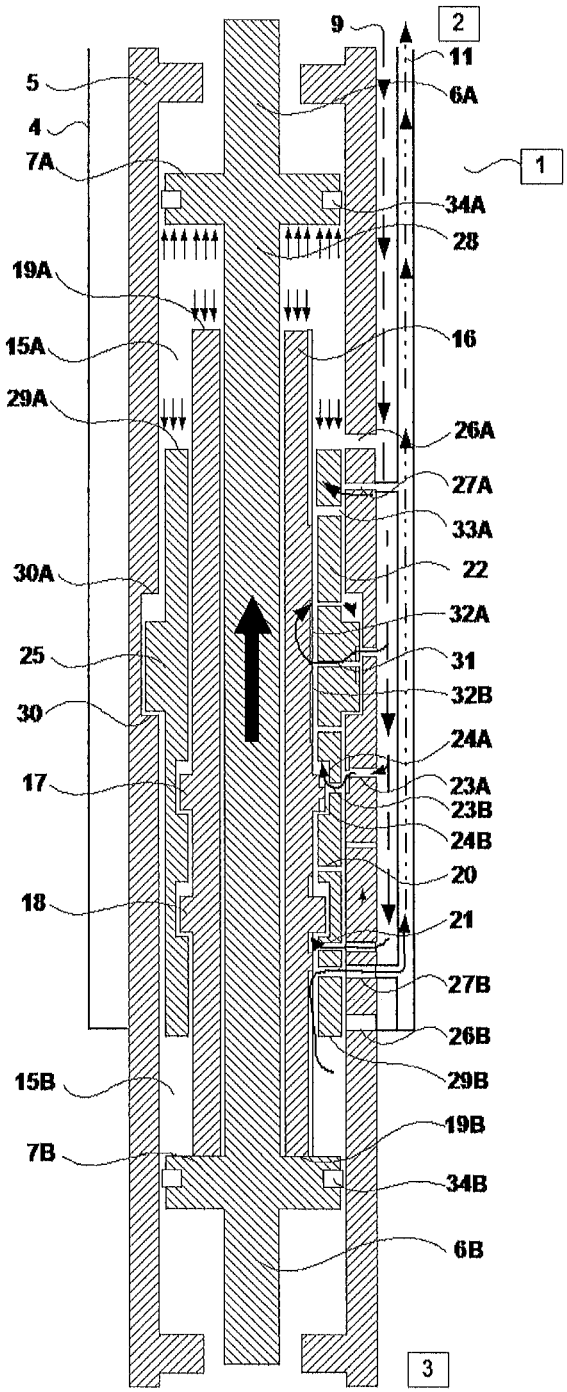
FIG. 7 is a schematic drawing of the valve assembly of FIG. 6 during a power stroke of a top piston, showing certain seals.
Figure 8:
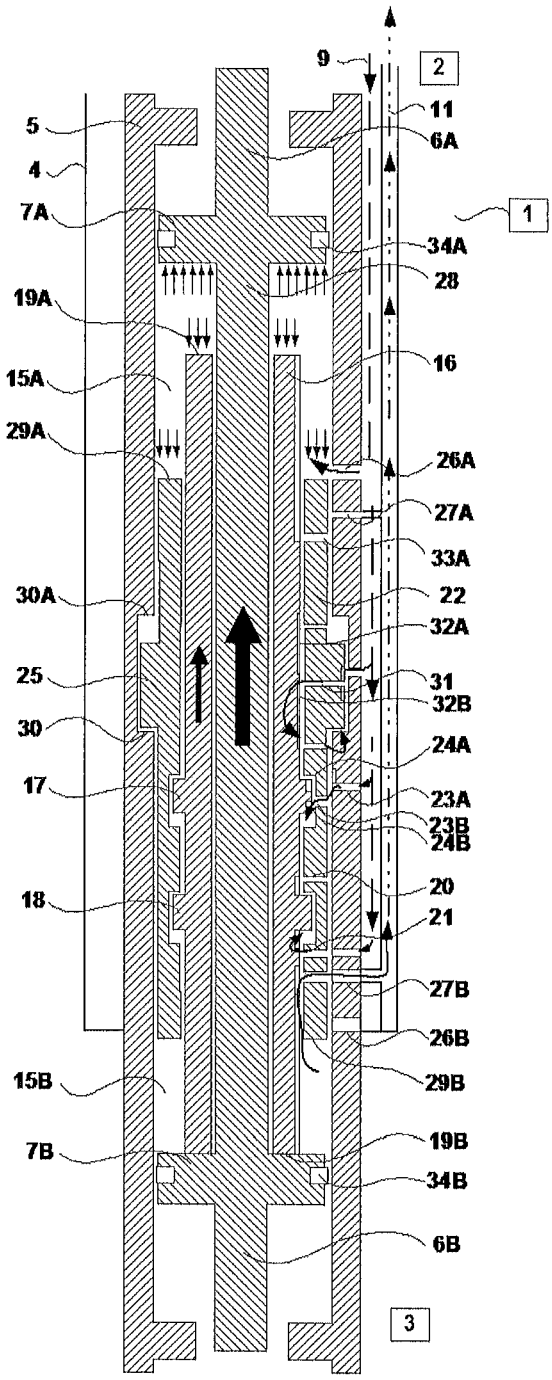
FIG. 8 is a schematic drawing of the valve assembly of FIG. 6 during a changing of motion by the top piston, showing certain seals.
Figure 9:
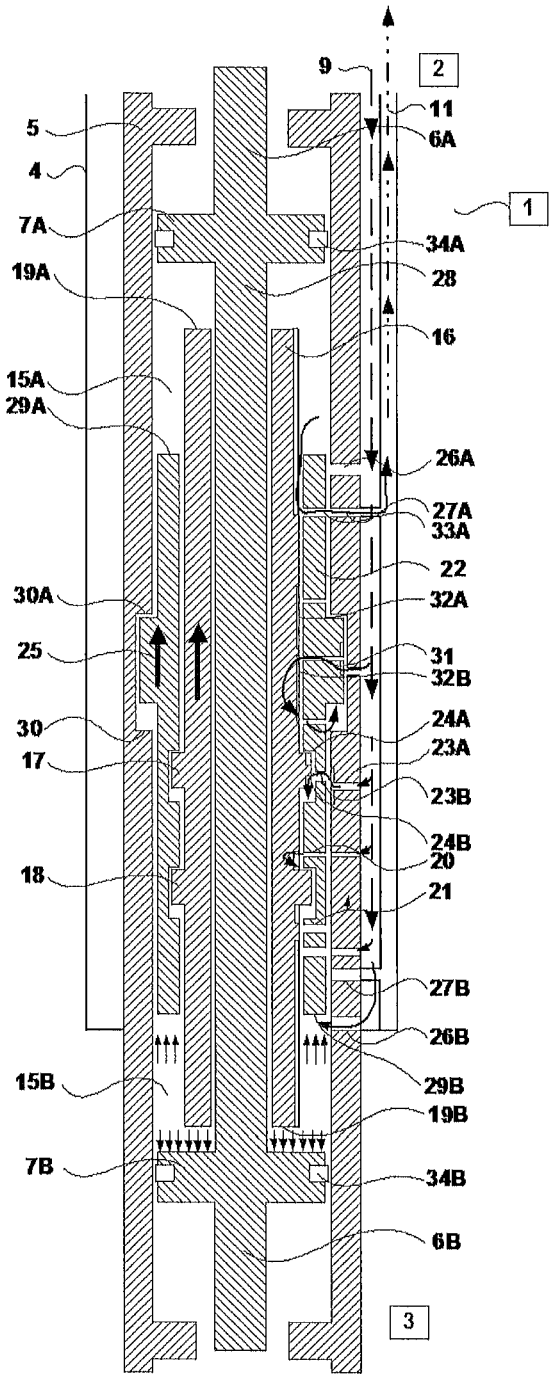
FIG. 9 is a schematic drawing of the valve assembly of FIG. 6 during a reversal of motion, showing certain seals.
Figure 10:
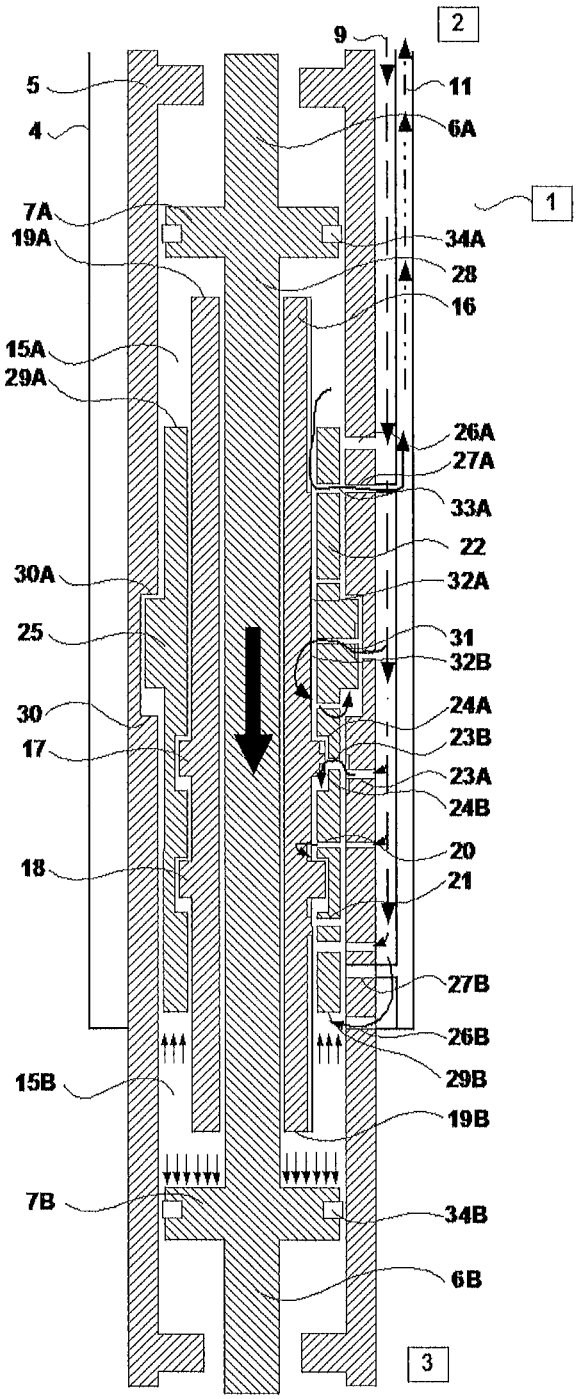
FIG. 10 is a schematic drawing of the valve assembly of FIG. 6 during a discharge stroke of the top piston, showing certain seals.

Referring to FIG. 5, when the reversing sleeve 22 has been shifted towards the first end 2 of the assembly 1 until the reversing sleeve 22 has been stopped by the bumper 30A, the reversing sleeve 22 can expose the second power fluid inlet port 26B, which allows power fluid to enter the second compression chamber 15B, while at the same time can align the first housing exhaust port 27A with the exhaust port 33A which can allow fluid in the first compression chamber 15A to be vented. With power fluid entering the second compression chamber 15B and the first compression chamber 15A being vented, the second piston 7B maybe driven by the power fluid in the second compression chamber 15B through a power stroke, while the first piston 7A maybe pulled through a discharge stroke by the connection rod 28.

When the second piston 7B reaches a bottom of the power stroke, the reversing sleeve 22 and the reversing spool 16 may act in conjunction to change the direction of motion of the first piston 7A and the piston 7B.

It will be obvious that the stroke length can be altered to suit the characteristics required by the equipment the motor is to power. Similarly, a number of motors could be arranged in gangs to provide power in small diameter settings. While particularly well suited to be deployed downhole in a well to power a reciprocating pump with a pump chamber at either or both ends of the motor, it is apparent that the motor may be used in other settings to power other equipment. Power fluids can be any one or more of a variety of suitable fluids, including for example liquids or gases of suitable compressibility to transfer fluid flow at pressures and volumes sufficient to power the motor in operation remotely from the pressurized fluid's source.

Additionally, the invention provides that the working chambers of the pistons and cylinders of the motor may always be kept at higher pressures than the motor's environment, thus isolating the motor's moving parts within an environment provided by the power fluid, which can be significantly cleaner and qualitatively controlled than the motor's external environment. Seals, if any, between the moving components of the motor, are similarly operative in a controlled environment, with higher pressure on the same side of each seal between the motor and its environment (the motor's side) during all strokes, with any leakage essentially flushing the seals' path of motion. It is to be noted that alterations to the diameter of the connecting rod, the exposed surface areas of the sleeve and spool, and the hydraulically active surface areas of the various position and balancing pistons and chambers, the volumes of the various active chambers and relative surface areas of the pistons in the motor will permit the alteration of motor operating parameters such as stroke, power, reciprocation speed, stall and the like, and to power fluid pressure and volumes required for specific motor outputs.

Similarly, unbalanced situations may be desired, and variance of conduit size or duration of conductivity during a stroke might provide more or less power or speed to one stroke versus the stroke in the opposite direction. As well, more than one power piston might be deployed on one or both sides of the valve arrangement.

The detailed description of the valve assembly is provided to enable any person skilled in the art to make or use the present invention. Various modifications to this invention will be readily apparent to those skilled in the art, and the generic principles defined herein may be applied without departing from the spirit or scope of the invention. Thus, the present invention is not intended to be limited to the embodiment shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the embodiment described throughout the disclosure that are known or later come to be known to those ordinary skill in the art are intended to be encompassed by the elements of the claims. Moreover, nothing disclosed herein is intended to be dedicated to the public regardless of whether such disclosure is explicitly recited in the claims.

The invention claimed is:

1. A motor for providing powered reciprocating linear drive motion using a pressurized power fluid flow, the motor comprising:

a housing having a first end and a second end;

a first chamber provided in the housing proximate the first end of the housing, the first chamber having a first piston and operative to provide motive linear power during a power stroke of the first piston;

a second compression chamber provided in the housing proximate the second end of the body, the second compression chamber having a second piston and operative to provide motive linear power during a power stroke of the second piston the second piston connected to the first piston such that a power stroke of the first piston causes an exhaust stroke of the second piston and a power stroke of the second piston causes an exhaust stroke of the first piston;

the first chamber in fluid communication with the power fluid flow during a power stroke of the first piston and in fluid communication with a first exhaust port during an exhaust stroke of the first piston;

the second chamber in fluid communication with the power fluid flow during a power stroke of the second piston and in fluid communication with a second exhaust port during an exhaust stroke of the second piston;

a reversing sleeve provided between the first piston and the second piston, the reversing sleeve having a first end partially defining the first chamber and a second end partially defining the second chamber, wherein the reversing sleeve is operative to expose the first chamber to the first exhaust port during an exhaust stroke of the first piston and to block the first exhaust port during a power stroke of the first piston and is operative to expose the first chamber to the first power fluid inlet port during a power stroke of the first piston and to block the first power fluid inlet port during an exhaust stroke of the first piston and is operative to expose the first power fluid inlet port during a power stroke of the first piston, and wherein the reversing sleeve is operative to expose the second chamber to the second exhaust port during an exhaust stroke of the second piston and block the second exhaust port during a power stroke of the second piston, and is operative to expose the second chamber to a power fluid inlet port during a power stroke of the second piston and to block the second power fluid inlet port during an exhaust stroke of the second piston;

wherein the reversing sleeve has a first reversing sleeve exhaust port, in fluid communicating with the first chamber, that substantially aligns with the first exhaust port during an exhaust stroke of the first piston and a second reversing sleeve exhaust port, in fluid communication with the second chamber, that substantially aligns with the second exhaust port during an exhaust stroke of the second piston;

further comprising a first inlet port in fluid communication with at least one power fluid supply and a second inlet port in fluid communication with the at least one power fluid supply, wherein the first chamber is in fluid communication with the first inlet port during a power stroke of the first piston and the second chamber is in fluid communication with the second inlet port during a power stroke of the second piston, and where the reversing sleeve blocks the first chamber from the first inlet port during an exhaust stroke of the first piston and the reversing sleeve blocks the second chamber from the second inlet port during an exhaust stroke of the second piston;

a separate reversing spool provided within the reversing sleeve and having a first end and a second end, the reversing sleeve and the reversing spool partially defining the first chamber and the second chamber;

wherein when the first piston in its motion is proximate an end of its power stroke, the second piston contacts the second end of the reversing spool, forcing the reversing spool towards the first piston, and moving the reversing sleeve towards the first piston causing the reversing sleeve to place the second chamber in fluid communication with the power fluid flow and venting the first chamber to exhaust;

and wherein when the second piston in its motion is proximate an end of its power stroke, the first piston contacts the first end of the reversing spool, forcing the reversing spool towards the second piston and causing the reversing sleeve to place the first chamber in fluid communication with the at least one power fluid supply and venting the second chamber to exhaust.

2. The motor of claim 1 where the reversing spool includes a position piston to hold the reversing spool in position and a balancing pressure piston to counteract pressure forces on the reversing spool,

3. The motor of claim 1 wherein the first piston, the first chamber, a connecting rod connected between the first piston and the second piston, the second piston and the second compression chamber are all aligned along a single line.

4. The motor of claim 1 wherein the housing and an outer housing are cylindrical.

5. The motor of claim 1 wherein the first chamber and second chamber are in fluid isolation from each other.

6. The motor of claim 1 with seals isolating the motor and its environment.

7. The motor of claim 6 further comprising a first sealing ring encircling the outer circumference of the first piston and separating the motor's environment from the first chamber and a second sealing ring encircling the outer circumference of the second piston and separating the motor's environment from the second chamber, the rings forming dynamic seals at the mating faces of the pistons' outer circumferences and their respective cylinders.

8. A motor with a hydraulic/pneumatic valve for converting one directional flow of power medium into mechanical reciprocating motion, the motor comprising:

a first piston, acting at the same time as an attaching platform to a mechanism to be powered by the motor, defining a first compression chamber and a second piston, acting at the same time as an attaching platform to the mechanism to be powered by the motor, defining a second compression chamber, the pistons connected together with a connecting rod so that the first piston and the second piston are forced to move in conjunction by tension on the rod;

around the connecting rod, a valve comprising a reversing spool provided within a separate reversing sleeve each having a first end and a second end, the ends of the reversing sleeve and the reversing spool partially defining the first compression chamber and the second compression chamber;

the reversing sleeve having a first end partially defining the first compression chamber and a second end partially defining the second compression chamber, operates to open the first compression chamber to the power fluid flow and open the second compression chamber to an exhaust vent during the first piston power stroke, and to open the second compression chamber to the power fluid and open the first compression chamber to the exhaust vent during the second piston power stroke;

when the first piston is proximate an end of its power stroke, the second piston contacts the second end of the reversing spool, forcing the reversing spool towards the first piston, contacting the reversing spool and moving the reversing spool towards the first piston causing the reversing spool to place the second valve chamber in fluid communication with the at least one power fluid supply and venting the first valve chamber to exhaust and forcing the reversing sleeve towards the first piston;

and when the second piston is proximate an end of its power stroke, the first piston contacts the first end of the reversing spool, forcing the reversing spool towards the second piston and causing the reversing spool to place the first compression chamber in fluid communication with the at least one power fluid supply and venting the second compression chamber and forcing the reversing sleeve towards the second piston.

9. The motor of claim 8 where the valve's reversing spool also includes a position piston to hold the reversing spool in position and a balancing pressure piston to counteract pressure forces on the reversing spool.

10. The motor of claim 8 wherein the first piston, the first compression chamber, the connecting rod connected between the first piston and the second piston, the second compression chamber and the second piston are all aligned in a line.

11. A method of inducing a reciprocating movement to a motor's connecting rod, the method comprising:

providing a valve having a first piston defining a first compression chamber, a second piston defining a second compression chamber, the first and the second piston connected with a connecting rod so that the first piston and the second piston move in unison, the first chamber and the second chamber positioned between the first and the second piston;

supplying power fluid to the first chamber to drive the first piston through a power stroke and the second piston through an exhaust stroke;

when the first piston reaches an end of its power stroke, switching the supply of power fluid to the second chamber to drive the second piston through a power stroke and the first piston through an exhaust stroke;

when the first piston has reached the end of the exhaust stroke, switching the supply of power fluid back to the first chamber;

the switching being done by a reversing sleeve in combination with a separate reversing spool, the reversing sleeve provided between the first piston and the second piston, the reversing sleeve having a first end partially defining the first chamber and a second end partially defining the second chamber, wherein the reversing sleeve is operative to expose the first chamber to a first exhaust port and to block power fluid during an exhaust stroke of the first piston and to block the first exhaust port during a power stroke of the first piston, and wherein the reversing sleeve is operative to expose the second chamber to a second exhaust port and to block power fluid during an exhaust stroke of the second piston and block the second exhaust port during a power stroke of the second piston, and the reversing sleeve is operative to expose the first chamber to a first power fluid port during a power stroke of the first piston while the first exhaust port is blocked by the reversing sleeve, and to expose the second chamber to a second power fluid port during a power stroke of the second piston while the second exhaust port is blocked by the reversing sleeve; and with a reversing spool provided within the reversing sleeve and having a first end and a second end, the reversing sleeve and the reversing spool partially defining the first chamber and the second chamber; when the first piston in its motion is proximate the end of the travel of its power stroke, the second piston contact the second end of the reversing spool, forcing the reversing spool toward the first piston and moving the reversing sleeve towards the first piston causing the reversing sleeve to place the second chamber in fluid communication with the second power fluid port while blocking the second exhaust port and the first chamber in fluid communication with the first exhaust port while blocking the first power fluid port and when the second piston in its motion is proximate the end of the travel of its power stroke, the first piston contact the first end of the reversing spool, forcing the reversing spool toward the second piston and moving the reversing sleeve towards the second piston causing the reversing sleeve to place the first chamber in fluid communication with the first power fluid port while blocking the first exhaust port and the second chamber in fluid communication with the second exhaust port while blocking the second power fluid port.

* * * * *